United States Patent [19]

Flatau et al.

[11] 4,301,736

[45] Nov. 24, 1981

[54] SUPERSONIC, LOW DRAG TUBULAR PROJECTILE

[75] Inventors: Abraham Flatau, Joppa; Joseph Huerta, Aberdeen, both of Md.

[73] Assignee: The United States of America as represented by the Secretary of the Army, Washington, D.C.

[21] Appl. No.: 20,140

[22] Filed: Mar. 13, 1979

Related U.S. Application Data

[63] Continuation-in-part of Ser. No. 670,814, Mar. 26, 1976, abandoned.

[51] Int. Cl.[3] ..... F42B 11/00; F42B 13/00

[52] U.S. Cl. ..... 102/503; 102/501

[58] Field of Search ..... 102/92.1–92.7, 102/93, DIG. 10; 244/3.1; 102/501, 503

[56] References Cited

U.S. PATENT DOCUMENTS

| | | | |
|---|---|---|---|
| 1,149,679 | 8/1915 | Parker | 102/DIG. 10 |
| 4,164,904 | 8/1979 | Laviolette | 102/92.7 |

FOREIGN PATENT DOCUMENTS

| | | | |
|---|---|---|---|
| 308434 | 2/1920 | Fed. Rep. of Germany | 102/92.1 |
| 245458 | 5/1975 | Fed. Rep. of Germany | 102/92.1 |
| 844987 | 5/1939 | France | 102/92.1 |
| 22432 | 2/1980 | France | 102/DIG. 10 |
| 470648 | 3/1969 | Switzerland | 102/92.1 |

*Primary Examiner*—Harold J. Tudor

*Attorney, Agent, or Firm*—Nathan Edelberg; Robert P. Gibson; Harold H. Card, Jr.

[57] ABSTRACT

A hollow tubular projectile is disclosed having about 30 percent less mass than conventional ammunition projectiles and considerably less drag, as a result of precise aerodynamic design details.

12 Claims, 11 Drawing Figures

SUPERSONIC, LOW DRAG TUBULAR PROJECTILE

STATEMENT OF INTEREST

This invention can be used by or for the United States Government without the payment of royalties thereon.

This application is a continuation-in-part of previous application, Ser. No. 670,814, filed 26 Mar. 26, 1976, since abandoned.

BACKGROUND OF THE INVENTION

Conventional ammunition projectiles such as used both in small caliber and large caliber weapons typically comprises a solid mass with a rounded nose or ogive portion, a generally cylindrical body and an aft or tail portion terminating abruptly in a flat surface normal to the longitudinal center axis of the cylindrical body. Since projectiles used in weaponry usually leave the gun tube or barrel at supersonic velocity, a relatively blunt nose produces very high drag force and the familiar parabolic shock wave. The blunt tail section results in considerable turbulene aft of the projectile which translates into further drag force from conversion of energy from the projectile to the surrounding mass of air.

Numerous design efforts have been used to reduce total drag on projectiles and thereby increases their impact force. Foremost among these efforts is the use of a hollow center passage thru the projectile such as to form a tubular shape. Some examples of the prior art demonstrating this design approach are shown in FIGS. 1 through 6.

An English inventor named Whitworth designed projectile 16 shown in FIG. 1 about 1857. Hole 17 is provided thru an elongate body 18 having a polygonal cross-section configuration resulting in multiple external surfaces as shown. There is little historical evidence that the design approach was ever adopted or actually used in warfare, from which it appears that it drew very little interest among those working in the ballistic art. The projectile suggested in FIG. 2 and variations thereof were used experimentally in 1893 by someone named Hebler of Switzerland. Projectile 19 was a conventional projectile with a longitudinal passage 20 provided through the axial center thereof. The experiments became known as the Krnka-Hebler experiments. Interest in the United States was evidenced in 1894 when experiments were conducted at Frankford Arsenal, Philadelphia, Pennsylvania. Experimental bullets having the configuration shown in FIG. 2 are described in "History of Modern US Military Small Arms Ammunition," by F. W. Hackley et al, and published by MacMillan and Company in 1967. As a result of the experiments, it was concluded that conventional projectiles with center holes therethrough provided no benefit with respect to air resistance or drag.

Following World War II, considerable information was accumulated concerning internal aerodynamics of supersonic flow in ducts and diffusers for various aerodynamic applications. Much of the accumulated data is useful in the analysis of ballistic projectiles, particularly those of tubular form. Through theoretical study and experimentation, it is known that the normal shock wave generated in front of the air inlet duct of a jet engine of supersonic aircraft as they exceed sonic velocity could be "swallowed" by the duct at some predetermined design Mach number. This refers to a steady-state phenomenon at certain supersonic airflow velocities whereby the normal shock at the duct inlet disappears and mass flow efficiency through the duct rises sharply. The noted phenomenon has application in the design of ballistic projectiles whereby the normal bow shock is not present under ideal supersonic flow conditions, resulting in a dramatic reduction in total drag force. This flow condition requires certain precise combinations with regard to cross sectional size of the internal and external surfaces of the hollow projectile and with further regard to the launching velocity thereof. Since projectiles fired from guns normally receive their total propelling force within the gun tube or barrel, their highest velocity is achieved as they leave the gun muzzle, after which deceleration occurs throughout their projectory. As a result, air flow conditions relating to the external ballistics of any projectile are necessarily transient and never completely constant. However, hollow tubular projectiles can be designed to swallow the normal bow shock at particular launch velocities above Mach 3 and to retain the supersonic internal flow characteristics associated with this phenomenon throughout a certain narrow range of supersonic air flow velocities. It has been found through experimentation that during deceleration of the projectile the internal flow experiences an abrupt change whereby a bow shock wave appears at the nose of the projectile and subsonic flow occurs through the center passage. This condition is called "choking" and is accompanied by a sharp increase in drag.

In recent years, interest has renewed in pursuing the elusive technical answers to ballistical problems familiar to those skilled in the art. Projectile 21 shown in FIG. 3 illustrates one attempt to reduce drag in a hollow projectile by providing a smooth straight cylindrical inner surface 24 of constant cross sectional area throughout the length of the center passage. The external contour of projectile 21 includes a shallow conical or bevel surface 22 forming a leading edge at the inlet of passage 24, while another conical surface 23 intersects with surface 22 and terminates in a trailing edge at the aft end of the projectile. Due to the constant cross sectional area of passage 24 in FIG. 3, supersonic air flow will not occur in the passage. Moreover, although sharp leading and trailing edges are provided by the projectile shape in FIG. 3, use of shallow angles defining conical surfaces 22 and 23 result in very thin wall thickness of the projectile with a consequent low mass. FIG. 4 shows projectile 25 with straight cylindrical outer surface 27 having a constant cross sectional diameter and oppositely directed conical inner surfaces resulting in a throat section at the intersection thereof. Inner surface 26 thus comprises a compression section since the cross sectional area of the inlet at the leading edge of projectile 25 is obviously larger than the cross sectional area at the throat. However, the considerable length of the conical surfaces used for the inner passage of projectile 25 produces the same problem as stated regarding FIG. 3; namely, insufficient projectile mass for use in weaponry. FIG. 5 shows another design approach for projectile 28 wherein the mass is maintained at an acceptable high level through the use of relatively thick walls, while drag is reduced by providing conical surface 30 which intersects surface 29 to provide a sharp leading edge. Actual experiments with projectile 28 have had very disappointing results for reasons which will appear below. The projectile shown in FIG. 6 is a theoretical model for a low drag tubular shape which has been known for years. It suggests a sharp-edged inlet 31 with a gradually tapering inner surface converging toward a throat section 32 immediately followed by a divergent aft section of increasing cross sectional area. While the aerodynamic flow characteristics thus achieved by the shape shown in FIG. 6 provides certain advantages, use of these inner surfaces with a straight cylindrical outer surface results in insufficient mass for military use as a projectile.

In considering the prior art including that represented by FIG. 1 through 6 discussed above, it must be emphasized that projectiles intended for use as weapons are required to have sufficient destructive force upon impact to result in catastrophic or incapacitating damage against hard targets. There is a clear relationship between projectile mass and terminal momentum. Where there is so little mass remaining after shaping the projectile to produce low drag aerodynamic characteristics close to the ideal such as shown in FIG. 6, total loss of usefulness as a destructive device results. Accordingly, conflicting design considerations are presented which involve trade-offs between velocity, mass, aerodynamic characteristics and payload capacity.

The ballistic characteristics of hollow projectiles is a highly empirical science. Minor changes of contour which seem insignificant to the uninitiated can make a decisive difference of success or failure in a design. It is not enough, for example, that the projectile have thin, highly polished walls and sharp leading and trailing edges as in the case of the projectiles shown in FIGS. 1 through 6. It was apparently the designer's objective in FIG. 6 to reduce drag by establishing efficient internal flow through use of the proper ratio of inlet area to throat area. The shallow internal angles shown in FIG. 6 would achieve that objective, but unavoidably produces insufficient projectile mass, which will result in relatively short range for any given launch velocity. The foregoing statement can be illustrated by the following example. If a steel ball-bearing the size of a ping-pong ball leaves a gun barrel with the same velocity used to launch a ping-pong ball, the steel projectile will travel considerably farther than the lightweight projectile due to the difference in their respective mass-momentum characteristics. It is therefore necessary in hollow projectile design that the walls be sufficiently thick to provide reasonable mass to achieve substantial range, and adequate volume to carry a useful payload. However, thick walls inevitably result in higher drag and larger cross-sectional area of the projectile, and it is a principal design objective in this case to overcome these effects aerodynamically.

SUMMARY OF THE INVENTION

The invention in this case includes a combination of design expedients, some of which have been suggested heretofore but not in the precise combination disclosed herein. Thus, projectile 1 shown in FIG. 7 broadly comprises a compression section a, a throat section b, and a diffuser section c. Section a at the foreward end of projectile 1 has inner and outer conical surfaces 5 and 7, respectively, which intersect to form a sharp leading edge lip 3 defining an air inlet having a predetermined cross-sectional area. Inlet surface 5 converges rearwardly until it intersects the cylindrical inner surface 10 of section b which has a constant cross-sectional area throughout its length. Section c has a conical inner surface 6 which intersects external bevel boattail surface 8 to form a trailing edge lip 4 defining an exit area of a predetermined cross-sectional size larger than the cross-sectional area of section b. The shape suggested in FIG. 7 for a tubular projectile and the precise dimensional interrelationship of the three sections a through c produce the new and unobvious results upon which the claimed features in this case are based.

DESCRIPTION OF THE PREFERRED EMBODIMENT

Figure 7:
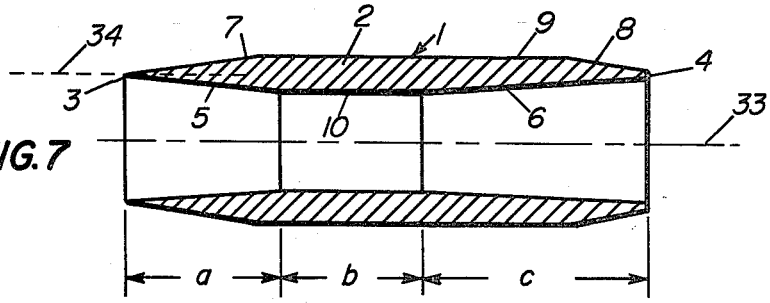
FIG. 7 is an elevational cross-sectional view taken along a vertical plane containing the center longitudinal axis of the inventive tubular projectile in this case.

Referring to FIG. 7, the inventive structure is an elongate hollow tubular projectile of circular cross-sectional form and symmetrical about a center longitudinal axis 33. Projectile 1 generally comprises a compression section a at the foreward end thereof which adjoins center throat section b. The aft portion c of projectile 1 is a diffuser section and adjoins center body section b. Compression section a includes inner and outer conical surfaces 5 and 7, respectively, which intersect to form a sharp leading edge 3 defining a plane normal to the center longitudinal axis 33 of the projectile. The cross-sectional area defined by converging surface 5 diminishes uniformally from a maximum at the inlet defined by lip 3 to a minimum at the plane defined by intersection of conical surface 5 with the inner cylindrical surface 10 of throat section b. Throat section b has a uniform diameter throughout its length resulting in a constant cross-sectional area thereof. Diffuser section c has a conical inner surface 6 which diverges from a minimum cross-sectional area in the plane defined by intersection of conical surface 6 with cylindrical surface 10 of section b and expands uniformly to a maximum cross-sectional area in the plane defined by trailing edge 4 of section c. The mentioned planes are all normal to axis 33.

Each of the separate design features thus represented in FIG. 7 is critical to the success of projectile 1 in achieving a substantial reduction of drag force over projectiles of corresponding size known to the prior art. Thus, for example, the use of an external bevel to achieve a thin leading edge in the manner of beveled surface 7 in FIG. 7 is important. This permits the inner conical surface 5 to be angled as necessary for the desired inlet-to-throat area ratio without sacrificing wall thickness and projectile mass. The inlet and throat areas are the cross-sectional areas at each end of section a shown in FIG. 7. The projectile wall thickness refers to the distance between outer surface 9 and inner surface 10 of section b.

Another key feature of the invention is the gradual expansion of airflow through the diffuser section c. Since drag is associated with such factors as local turbulence, expansion shock-waves and changes in the direction of air flow, a smooth and substantially uniform rate of expansion of captured air within projectile 1 is essential to the success of the round.

The overall design of projectile 1 and especially the area ratios and section lengths employed for the inlet, throat and diffusers are dependent upon the muzzle velocity which the round has when it leaves a gun barrel. Each caliber of round must be tailored to achieve swallowing of the bow shock at the very start of its trajectory and maintain minimum drag until flow velocity through the inner projectile body decays to the point where drag suddenly and inevitably increases sharply. It is a major design objective in the use of projectile 1 to achieve a range such that impact occurs before substantial decay in projectile velocity occurs whereby the round is more effective because it has greater force at impact due to relatively high mass momentum energy levels. Actual experiments using projectile 1 shown in FIG. 7 have achieved the foregoing objective at very considerable firing ranges such as 3,000 meters, involving muzzle velocities around 4,500 feet per second which is greater than Mach 4.

Another design expedient of great significance is the fact that the forward leading edge angle enclosed by surfaces 5 and 7 is specifically contoured such that the bisector of such angle seen in cross-section is parallel to the center axis of rotation of projectile 1 which coincides with the center longitudinal axis 33 of the projectile. This is seen from FIG. 7 wherein bisector 34 is parallel to axis 33. In addition to the advantages of aerodynamic balance thus produced, the foregoing feature of the leading edge angle results in higher column strength in projectile 1. Where the projectile trajectory is flat and horizontal, and the target surface is vertical, the surface will be impacted substantially uniformly about the entire leading edge 3 of projectile 1. Greater column strength means that a more efficient transfer of energy from the projectile to the target material will occur than if such energy is partly consumed by deforming or structurally failing the projectile. This is referred to as the terminal ballistic property of the projectile which relates to its impact characteristics. Projectile 1, partly due to its higher velocity and partly due to its high column strength through symmetrical loading at the leading edge upon impact, achieves higher hit force and penetrating power than nonsymmetrical leading edge angles will produce. Moreover, penetration of leading edge lip 3 through an air mass is more efficient if perturbations are minimized and flow symmetry is preserved as much as possible. Where the inner and outer surfaces 5 and 7 are angularly symmetrical about bisector 34, the wedging action of each surface on an air mass will produce substantially identical displacement forces on such mass, with commensurately symmetricaly flow patterns and similar reaction force vectors on projectile 1. Where bisector 34 converges upwardly round axis 33, more air is collected inside the projectile than necessary, and choking becomes more likely. Where bisector 34 diverges downwardly more air is spilled outwardly by lip 3 than is captured by the inlet, which tends to simulate a blunt-nosed projectile characterized by an external bow shock.

The precise configuration of projectile 1 results from recognition of the fact that inlet and outlet flow patterns in a hollow tubular projectile are not equal or identical. The functions performed by each of sections a, b and c with regard to internal flow differ. Hollow projectiles in the prior art which are symmetrical about a center vertical axis such as the projectile shown in FIG. 6, overlook this fact since the inlet compression angle between area 31 and area 32 is identical to the expansion section between area 32 and the trailing edge lip of the projectile.

More specifically, it will be seen from FIG. 7 that compression section a is noticeably shorter than diffuser section c. This results from the fact that compression holds the air flow close to the surface 5, whereas air flow tends to separate from surface 6 during expansion. Compression of inlet air occurs at a rate dependent upon the distance between the inlet and throat areas at each end of section a, as well as upon the ratio of these areas. If such areas are too closely situated or if the ratio is less than 0.6, compression will be too abrupt and will result in choking. When choking occurs within compression section a, the ballistic characteristics of hollow projectile 1 are substantially identical with a solid blunt-nosed projectile of conventional design. Accordingly, the cross-sectional area of throat section b should not be less than 0.6 of the inlet area defined by lip 3 and the distance a between these two mentioned areas must not be less than the diameter of the inlet area.

Figure 1:
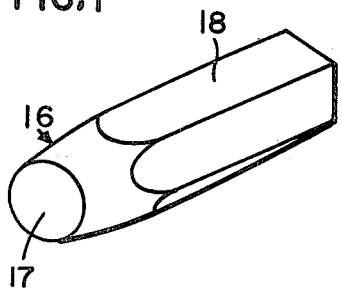
FIGS. 1 through 6 show various tubular projectiles known to the prior art.
Figure 2:
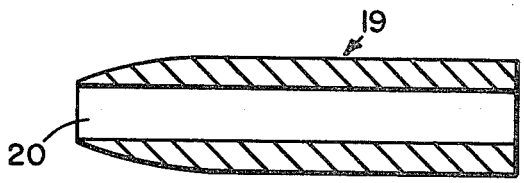
Figure 3:
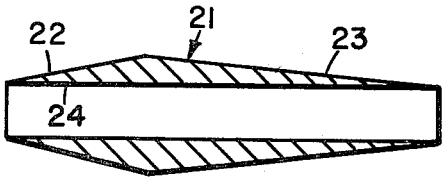
Figure 4:
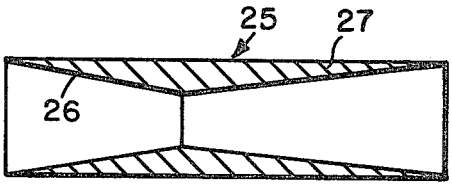
Figure 6:
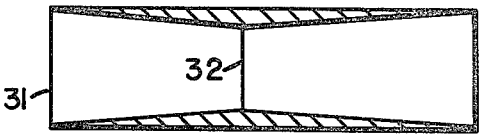

A further critical feature of projectile 1 is the use of an elongated throat defined by section b rather than the minimum diameter throat section lying in a single plane such as suggested in FIGS. 4 and 6. In the single plane throat, air under compression after supersonic velocities through the inlet, upon reaching the sharp edged throat will separate from the inner surface of the duct or center passage through the projectile and will produce violent turbulence. The use of an elongated throat section such as defined by cylindrical surface 10 in FIG. 7 results in a smoother transition from the compression action in section a to a substantially steady-state flow condition near the aft end of the throat section. Throat section b provides a continuous uniform cross-sectional area bearing surface 10 which applies symmetrical force constraints around the moving body of air such as to stabilize its direction and velocity, and avoids separation of the flow from such surface or other erratic influences. To achieve the mentioned results, it is preferable that the length of throat section b be not less than one-half the diameter of the throat section nor greater than 2½ times such diameter. In FIGS. 4 and 6, for example, the abrupt transition from compression to expansion at supersonic velocities will cause separation of air flow at the planar throat section and consider the drag due to turbulence in the expansion section.

Figure 5:
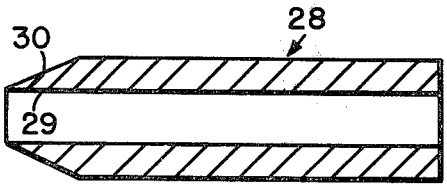

Referring to FIG. 7, the enclosed angle defined by the conical inner surface 6 of diffuser section c is limited to a range within which flow separation of the inner air flow from surface 6 will not occur. Thus, the exit area defined by trailing edge 4 and the lateral distance between the exit area and the throat area of section b must be within a range which will permit gradual expansion of the air stream within the throat so that it continues to fill the total area along the length of diffuser section 6 rather than separating and causing turbulence, especially at the intersection of surfaces 6 and 10 where the expansion process begins. If expansion is brief or abrupt such as in projectile 28 of FIG. 5, extreme turbulence and consequent high drag forces result. Because the tendency for air flow to separate away from inner surface 6 during expansion is greater than from surface 5 during compression, section c is preferably longer than section a, as seen in FIG. 7.

The inlet lip geometry for lip 3 is very significant, since it has been found that the enclosed angle defined by inner surface 5 and outer surface 7 should not exceed 15° total. Similarly, inner surface 6 of section c should not exceed a 5 degree divergence relative to center axis 33 or a total enclosed angle of 10 degrees. Conical surface 8 should not exceed 10 degrees maximum relative to the center axis 33. Thus, the enclosed angle defined by surfaces 6 and 8 in cross section such as shown by FIG. 7 should not exceed 15 degrees maximum.

Figure 8:
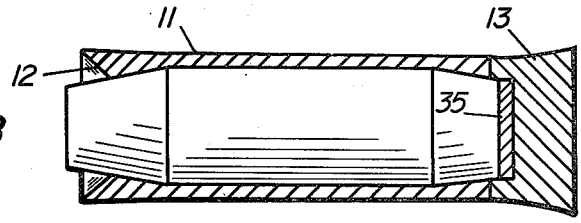
FIG. 8 is a side elevational view, partly in cross section, of the projectile from FIG. 7 operatively interrelated with components necessary for launching the same.

It is a separate but important feature of the invention in this case that the trailing edge 4 is not razor sharp but has a flat bearing surface formed thereon with a small but definite cross-sectional area adapted to bear against a pusher disc 35 shown in cross section in FIG. 8. The disc is preferably of hard material of sufficient rigidity to transmit very high acceleration forces from propellant gases within a gun tube (not shown) to projectile 1 during the initial firing thereof from a weapon. The bearing surface defined by trailing edge 4 is of annular shape and planar in form adapted to make substantially uniform surface area contact with an oppositely confronting planar surface of disc 35.

The inventive concept thus shown in FIG. 7 and described above may be applied to a wide variety of weapon projectile sizes. Since it is hollow, and since it is fired from gun barrels having rifled bores to impart rotation inside the gun tube, some means must be provided to prevent passage of gases produced by burning propellants in the gun tube through the center of the projectile such as would lower the launching pressures considerably. An illustrative approach to the problem is suggested in FIG. 8 showing force-transmitting means comprising a two-part sabot having an outer sleeve 11 and an obturator portion 13 operatively related to the projectile for launching. The obturator portion 13 has disc 35 secured therewithin and bears against sleeve portion 11. Both portions are generally required to engage and forcibly hold projectile 1 with sufficient force to prevent relative movement between these components during launch of the projectile. Thus, rotating force imparted to sleeve 11 must be transmitted by the sleeve to the projectile, and this is accomplished by snug juxtaposition of their respective faying surfaces which must be in close, substantially uniform contact over most of their area. After launch from the gun muzzle, high impact forces will result from contact of the atmosphere with conical surface 12 at the forward end of sleeve 11 which will result in force vectors radially outward such as to peel the sleeve away from the projectile. Similarly, air impact forces will separate obturator 13 and disc 35, leaving projectile 1 to proceed to the target unencumbered.

Figure 9:
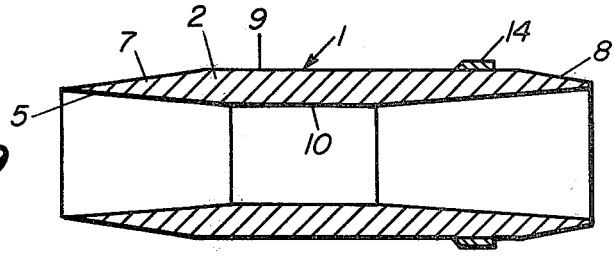
FIG. 9 is a view corresponding to FIG. 7 with the addition of a rotating band on the projectile.

Alternatively, sleeve 11 may be omitted as seen in FIG. 9 and projectile 1 may be provided with a relatively soft metal rotating band 14 adapted to engage the rifling within the gun bore to receive rotating force during its travel down the gun barrel. Band 14 may be of the same material as projectile 1, in which case it could be integrally formed therewith. Otherwise, it may be swaged, force-fit or similarly secured to the projectile.

Figure 10:
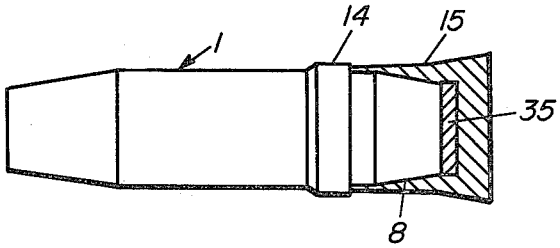
FIG. 10 is a side elevational view of the structure shown in FIG. 9 operatively related to a pusher disc for launching.

In FIG. 10, force may be applied to the projectile shown in FIG. 9 by use of unitary force transmitting member 15 into which boat tail surface 8 may be tightly nestled whereby element 15 transmits forward propulsion force through disc 35 to the projectile during launch, while rotation is imparted by band 14.

Figure 11:
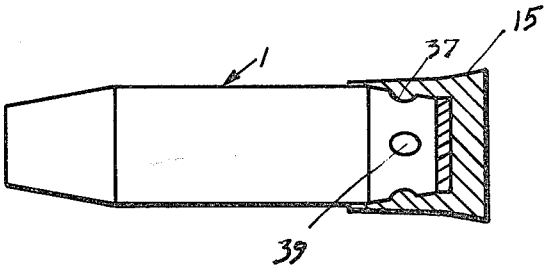
FIG. 11 is a modification of the structure shown in FIG. 10.

FIG. 11 shows a modification of the FIG. 10 structure wherein obturator 15, which may be made from relatively hard plastic, is provided with a plurality of small humps or protuberances 37 adapted to engage a corresponding plurality of depressions 39 so as to assure adequate force-transmitting interrelationship between obturator 15 and projectile 1 for rotation of the projectile as a result of obturator rotation within a gun barrel (not shown).

Actual comparison tests of the novel projectile 1 configuration in FIG. 7 have established beyond any doubt that the drag resulting from the inventive concept in this case is substantially less than that resulting from straight passages of substantially constant interconnecting cross-sectional area. Thus, for example, two projectiles having a shape essentially corresponding with that shown in FIG. 5, one having a leading edge lip enclosed of 15° and the other a corresponding angle of 10°, were compared with two projectiles shaped according to FIG. 7. The respective drag coefficients were as follows:

| CONFIGURATION | LE LIP ANGLE | $C_D$ |
|---|---|---|
| Test #1 | | |
| Constant Internal Diameter | 15° | .240 |
| FIG. 7 shape | 15° | .143 |
| Test #2 | | |
| Constant Internal Diameter | 10° | .183 |
| FIG. 7 shape | 10° | .105 |

We claim:

1. An elongate tubular projectile having a longitudinal center axis, consisting of:

a cylindrical center throat portion having a wall thickness defined by concentric inner and outer spaced-apart surfaces, a forward compression section adjoining said throat portion and formed by two converging conical surfaces intersecting each other to form a sharp leading edge and enclosing a V-shaped leading edge angle, the bisector of which in the longitudinal cross-section is substantially parallel to said longitudinal center axis, and an aft diffusion section adjoining said throat portion and formed by two converging conical surfaces forming a V-shaped trailing edge, said aft diffusion section having a smooth constant expansion angle and a smooth transition from said adjoining throat portion to said trailing edge, said throat portion having constant diameter throughout the length of said inner surface, said sharp leading edge defines a circular inlet having a predetermined first cross-sectional area for inlet airflow, said throat portion diameter defines a constant second cross-sectional area for airflow through said throat portion and the ratio of said second area to said first area is not less than 0.6.

2. The structure set forth in claim 1 above, wherein: said length of said throat portion is within a range from 0.5 to 2.5 times said diameter of said throat portion.

3. The structure of claim 2 above wherein:

the distance between said first and second areas is greater than said throat portion diameter.

4. The structure of claim 1, further including:

an external conical surface on said aft diffusion section extending in a constant slope from said throat portion outer surface to said trailing edge lip.

5. The structure of claim 1 above, wherein:

said aft section extends a distance along said center longitudinal axis at least as long as said forward compression section.

6. The structure in claim 1 wherein:

said length of said throat section is at least one half said diameter of said throat section.

7. The structure in claim 1 wherein:

said leading edge angle does not exceed 15° total.

8. The structure in claim 1 wherein:

said trailing edge includes a flat annular planar bearing surface.

9. The structure in claims 1 above, further including:

force transmitting means adapted to make snug, force transmitting contact with said throat portion and said aft section.

10. The structure in claim 1 above, further including:

a rotating band affixed to said projectile adapted to engage rifling within a gun bore and impart rotation to said projectile.

11. The structure in claim 6 above, further including:

force transmitting means adapted to make tight nestling engagement with said aft section for transmitting forward propulsion force thereto.

12. The structure in claim 11 above, wherein:

said force transmitting means includes a plurality of protruberances adapted to engage said aft section in force-transmitting relationship therewith.

* * * * *